US007354336B1

(12) United States Patent
Lalancette et al.

(10) Patent No.: US 7,354,336 B1
(45) Date of Patent: Apr. 8, 2008

(54) ABRADING TOOL AND METHOD FOR REFURBISHING ELECTRICAL CONNECTOR PIN CONTACTS

(75) Inventors: Serge Lalancette, Sainte-Julie (CA); Serge Castonguay, Longueuil (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 0 days.

(21) Appl. No.: 11/548,930

(22) Filed: Oct. 12, 2006

(51) Int. Cl.
*B24B 1/00* (2006.01)
*B24D 15/00* (2006.01)

(52) U.S. Cl. ..... 451/28; 451/525; 451/558; 451/908

(58) Field of Classification Search ..... 451/28, 451/46, 59, 908, 909, 490, 502, 514, 515, 451/517–525, 552, 557, 558; 15/104.04
See application file for complete search history.

(56) References Cited

U.S. PATENT DOCUMENTS 3,504,459 A * 4/1970 Spiteri ..... 451/525
3,616,283 A 10/1971 Magee et al.
3,616,285 A 10/1971 Norris
3,658,663 A 4/1972 Fukanuma et al.
3,698,083 A 10/1972 Schrek
4,001,982 A * 1/1977 Griffin et al. ..... 451/552
4,119,499 A 10/1978 Eidschun, Jr.
4,159,934 A 7/1979 Kadija
4,263,692 A * 4/1981 Gremillion ..... 15/210.1
4,280,882 A 7/1981 Hovey
4,301,567 A * 11/1981 Tucker ..... 15/160
4,575,892 A * 3/1986 Ross ..... 15/106
4,655,881 A 4/1987 Tezuka et al.
5,190,486 A 3/1993 Tsuk
5,342,992 A 8/1994 Noto
5,397,598 A 3/1995 DiPaolo et al.
5,448,016 A 9/1995 DiPaolo et al.
5,516,416 A 5/1996 Canaperi et al.
5,580,432 A 12/1996 Shibata et al.
5,890,252 A * 4/1999 Mellon ..... 15/104.001
6,051,119 A 4/2000 Findeis et al.
6,203,690 B1 3/2001 Findeis et al.
6,220,950 B1 * 4/2001 Novitsky ..... 451/558
6,364,671 B1 4/2002 Verneau
6,497,805 B2 12/2002 Lake et al.
6,527,935 B2 3/2003 Lopergolo et al.
6,701,566 B2 * 3/2004 Rooke ..... 15/104.04

* cited by examiner

*Primary Examiner*—Dung Van Nguyen
(74) *Attorney, Agent, or Firm*—Ogilvy Renault LLP

(57) ABSTRACT

An abrading tool for refurbishing pin contacts in situ in an electrical connector is provided. The abrading tool includes a bore defined in a first end for receiving the pin contacts therein and a transverse slot which intersects the bore. A removable abrading element is received within the slot and positioned therein in alignment with the bore.

17 Claims, 4 Drawing Sheets

ABRADING TOOL AND METHOD FOR REFURBISHING ELECTRICAL CONNECTOR PIN CONTACTS

TECHNICAL FIELD

The invention relates generally to refurbishment of electrical connectors and, more particularly, to the removal of the plating on pin contacts in electrical connectors.

BACKGROUND OF THE ART

Electrical wires or communication cables, especially those of an industrial grade, typically use connector plugs to interconnect a cable or wire to another cable, and/or to a source or destination of the transmitted electrical current or signal. Such electrical connectors often comprise pin contacts which are plated for improved performance and/or durability. However, such plating on the pins tends to wear out with time and with repeated use of the connector. When the plating on the pin contacts of such electrical connectors becomes worn or damaged, the connector itself, or the entire assembly of which they are a component, is often discarded and replaced. An improved tool and method for removing worn plating from such electrical pin contacts is desired, prior to the pins being subsequently re-plated.

SUMMARY OF THE INVENTION

It is therefore an object of this invention to provide an improved tool and method for removing plating from pin contacts of electrical connectors.

In one aspect, the present invention provides an abrading tool for refurbishing pin contacts in situ in an electrical connector, the abrading tool comprising an elongated body having a first end and a second end and a central longitudinal axis extending therebetween, a bore being defined in said first end concentric with the central longitudinal axis, the bore having a diameter at least as large as that of the pin contacts, a slot being defined in said first end, said slot extending transversely through the first end and intersecting the bore, and a removable abrading element positioned and maintained inside the slot and having a pin contact reception area communicating with the bore.

In a second aspect, the present invention provides an abrading tool for removing plating from a pin contact, the abrading tool comprising: an elongated body having a first and a second longitudinally opposite ends along a central longitudinal axis of the body, the second end being adapted for insertion into a drill mandrel, and the first end having a bore defined thereinto along a bore longitudinal depth, a transversal slot defined in a side of the elongated body immediately adjacent the first end and communicating with the bore along at least a portion of the bore longitudinal depth; and a removable abrading element received within the slot such that a pin contact reception area is aligned with the bore for abrasion of the pin contact when inserted therein.

In a third aspect, the present invention provides a process of removing the plating of a pin contact, the process comprising: providing an elongated abrading tool having a first end and a second end, a bore extending longitudinally into the first end and a transversal slot defined in the tool immediately adjacent the first end and communicating with the bore; positioning an abrading element having a pin contact reception area inside the bore by insertion thereof through the transversal slot; inserting the pin contact through an entrance of the bore and into the reception area of the abrading element; and rotating the abrading tool by the second end thereof, such that the abrading element abrades the plating of the pin contact.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Electrical communication cables are used for many different applications. In most industrial uses of electrical communication cables, plug-type connectors are provided on the ends thereof in order to be able to easily connect and disconnect the cable from the component or object to which it is plugged. For example, gas turbine engines typically employ a variety of surrounding accessories, such as electrical and/or hydraulic components, which require electrical communication cables, hydraulic lines and the like for communication between the accessory components and the engine itself. Such electrical communication cables, for example, are used to interconnect probes and sensors with an engine electronic controller. These electrical communication cables must be able to be readily engaged and disengaged when needed to allow installation and maintenance access to the accessory components and to the engine. Thus plug-type electrical connectors 90, as depicted in FIG. 1, are most often provided on the ends of such electrical communication cables to permit simple and efficient connection and disconnection of the cables with the corresponding mating plugs of the engine or accessory component.

Figure 1:
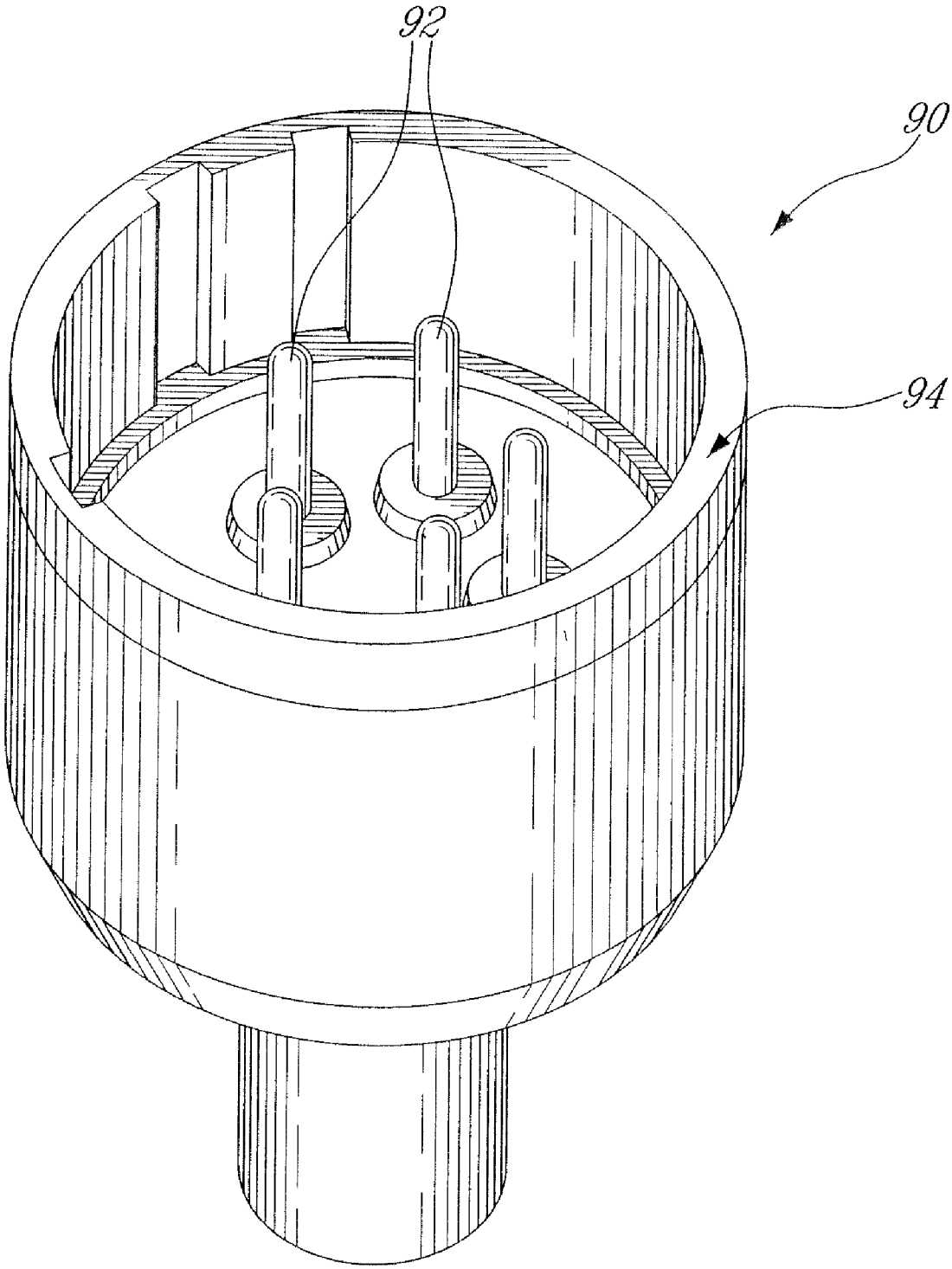
FIG. 1 is a perspective view of an electrical connector having pin contacts.

Plug-type electrical connectors 90 such as that depicted in FIG. 1 are also used in many other applications in which electrical communication cables are employed, such as, but certainly not limited to, electrical power systems, audio-visual equipment, electronics, or electrical control systems for vehicles and industrial machinery. In all such applications, it is common to use an electrical connector 90, which includes a plurality of upstanding pin contacts 92, which are circumscribed by a surrounding skirt 94. Accordingly, the pin contacts 92 are protected from abuse when not connected with the mating portion of the connector plug.

The pin contacts 92, especially when used for applications in which a high quality signal transmission is desired, are coated by a metallic plating which improves their conductivity, which in turn enhances the quality of their signal transmission. As such, the pin contacts 92 are often coated with a gold plating. The gold plating, however, tends to degrade or become damaged over time, with repeated insertion and removal of the pin contacts 92 of the electrical connector 90 with the mating sockets of the corresponding opposed connector, and/or as a result of severe environmental conditions, such as those to which all elements of gas turbine engines are exposed for example. The design of the connector 90, wherein the pin contacts 92 are provided relatively close to each other within a connector body which includes a surrounding skirt 94, reduces the likelihood of the pin contacts 92 becoming bent or damaged, however it also leaves limited access area around the pin contacts 92, which makes the pin contacts 92 difficult to access for maintenance.

The present invention provides a tool and method for removing the plating on the pin contacts 92 of the electrical connectors 90. The pin contacts can thereafter be refurbished in situ within the body of the electrical connector by any suitable method. This accordingly improves the ability to re-plate the pin contacts 92 in situ, thereby making repair of connectors having worn pin contact plating more feasible and provides an economically viable alternative to simply discarding worn connectors (and/or the entire assembly of which they are a component) and replacing them with new ones. Thus, parts which were often previously declared unserviceable due to pin contact plating deterioration, can be salvaged by efficiently removing existing pin plating in situ within the connector body without requiring any dismantling thereof, such that re-plating can subsequently occur, also in situ within the connector body.

Figure 2:
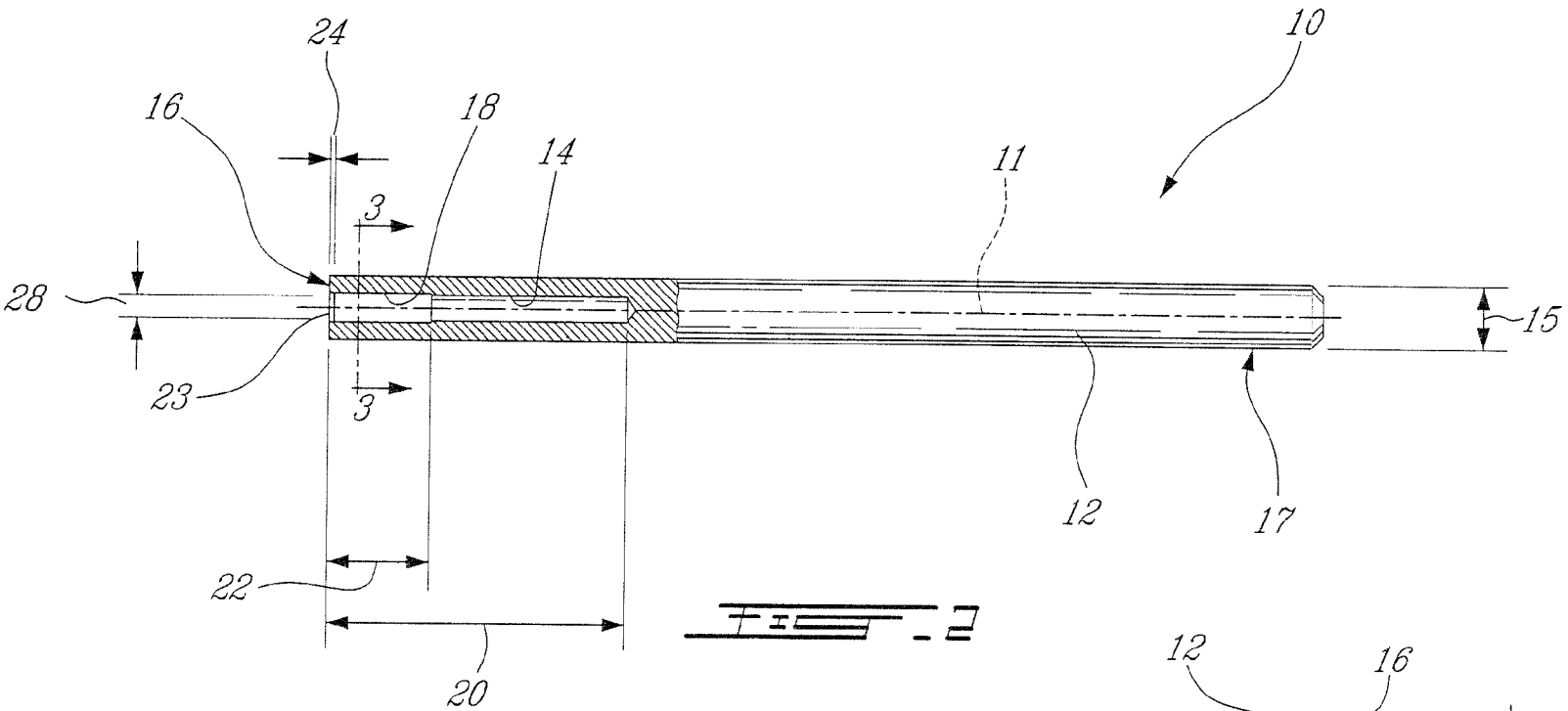
FIG. 2 is a partially sectioned side elevation view of a tool in accordance with a first aspect of the present invention.
Figure 3:
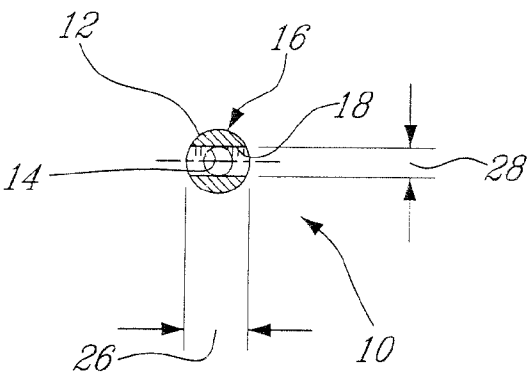
FIG. 3 is a cross-sectional view taken through line 3-3 of FIG. 2.

Referring to FIGS. 2 and 3, an abrading tool 10 is provided which permits the removal of plating on the electrical pin contacts 92 in situ within an electrical connector. The abrading tool 10 includes an elongated solid body 12 having a bore 14 defined in a first end 16 thereof. The second end 17 of the tool body 12, opposite the first end 16 along a longitudinal axis 11 of the tool 10, is sized such that it is receivable within the mandrel of a press drill or other machine tool operable to rotate the body 12 of the abrading tool 10 about its longitudinal central axis 11, as will be described in further detail below with regard to the method employed to refurbish pin contacts using the abrading tool 10.

The bore 14 in the first end 16 of the tool body 12 is sized such that it is sufficiently larger in diameter than a predetermined pin contact 92 of the electrical connector 90 to be refurbished, to allow the pin contact 92 to be received therein, with an abrading element 70 (FIGS. 4A and 4B) disposed between the pin contact 92 and the inner walls of the bore 14. The diameter or width 15 of the tool body 12 is minimized to allow insertion of the tool 10 onto pin contacts 92 having limited access area.

A transverse slot 18 is formed in the curved side wall 19 of the end 16 of the tool body 12, and extends into the bore 14 defined therein. The transverse slot 18 receives therein the abrading element 70 as will be detailed below. The slot 18 extends through the center of the bore 14 such that the slot 18 and the bore 14 are disposed in communication with each other.

The bore 14 extends into the tool body 12 a distance 20, corresponding to the bore depth from the remote end 16, along the longitudinal central axis 11 of the tool 10. The slot 18 is defined transversally to the axis 11 and has a slot length 22 which is less than the distance 20 defining the bore depth. The longitudinal position (i.e. along the side wall 19 and relative to the axis 11) of the slot 18 is chosen such that at least a small side wall section 23, having a minimized wall length 24 between the slot 18 and the first end 16, is maintained. In the embodiment of FIG. 3, the slot 18 extends transversally completely through the tool body 12. The width 28 of the slot 18 is selected taking into account the type of abrading element which will be received therein. In this example, the width 28 is slightly greater than the diameter of the bore 14, but it can be smaller or larger as required.

Figure 4B:
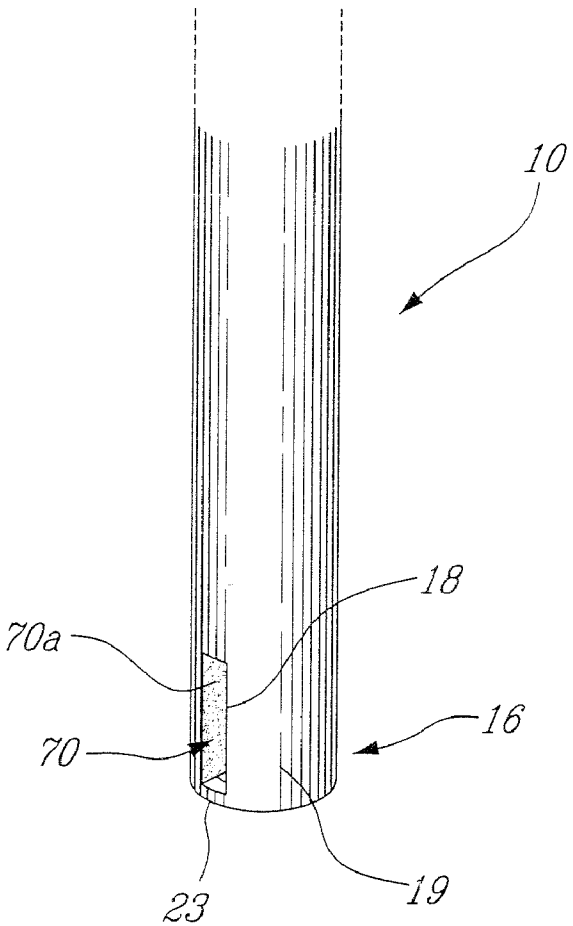
FIGS. 4A and 4B are perspective views showing the insertion of an abrading element into the tool of FIG. 2.
Figure 4A:
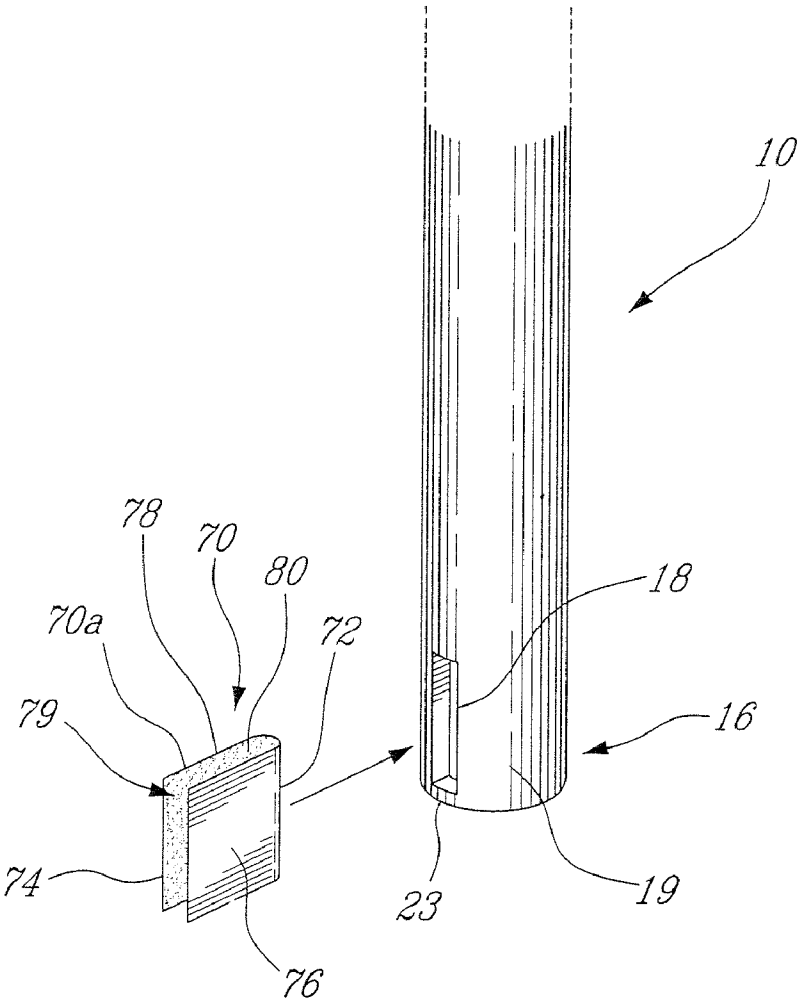

Turning now to FIGS. 4A and 4B, the abrading tool 10 is used with an abrading element 70, which may include a folded sheet material 70*a*, although it will be understood that other types of abrading elements 70 can be used as well. In this example, the abrading element 70 comprises a relatively flexible piece of sandpaper or lapping sheet to which an abrasive compound is applied, both of which can be folded. The folded sheet material 70*a* is folded into a U-shape along its length, defining a folded end 72 and an open end 74. The folded sheet material 70*a* therefore provides at least two superposed layers 76, 78 defining a pin contact reception area 80 therebetween which is at least partially enclosed by the inwardly-facing abrading surfaces 79 of the abrading element 70. Thus, when a pin contact of an electrical connector is inserted into the pin contact reception area 80 of the abrading element 70, the abrading surfaces 79 of the abrading element 70 come into contact with the pin contact such that the pin can be abraded when relative movement therebetween occurs. For installation, the folded end 72 of the folded sheet material 70*a* is inserted into the transverse slot 18 of the abrading tool 10. The length of the folded sheet material 70*a* can be selected or adjusted so that once it is inserted into the slot 18 (as shown on FIG. 4B), it precisely fits the slot 18 and neither the folded end 72 nor the open end 74 extend out from the ends of the slot 18.

In use, the pin contact 92 (FIG. 1) to be refurbished is inserted through the bore 14 (FIG. 2) and into the pin contact reception area 80 defined between the two folded layers 78 and 76 of the folded sheet material 70*a* of the abrading element 70 (FIGS. 4A and 4B). Relative rotating between the abrading tool 10 and the pin contact 92 then results in the surfaces of the pin contact 92 being abraded, whether this is to remove worn plating thereon or to re-finish the surface prior to re-plating.

The outer diameter of the abrading tool 10 is minimized to allow its engagement with pin contacts 92 which are located in restricted areas. Further, the length 24 of the small wall 23 is also minimized to allow the abrading element 70 to reach as far down as possible along the pin contact 92. The slot 18 is therefore located immediately adjacent the first end 16 of the abrading tool 10.

It has been found advantageous to use a slot 18 which has a depth 26 (FIG. 3) that corresponds to the diameter of the tool 10, such that the slot 18 extends fully between both side walls of the abrading tool 10 (i.e. extends completely transversely therethrough), because it is then possible to verify that the folded sheet material 70*a* is correctly positioned inside the slot 18 by visually inspecting the folded end 72 of the abrading element 70 from the side of the slot 18 opposite the side in which the folded end 72 is inserted. However, it will be appreciated that the slot 18 can alternately be provided with an opening thereto on only one side of the bore 14, instead of traversing the tool 10 completely.

The width 28 (FIG. 3) of the slot 18 can vary relative to the diameter of the bore 14. Slot widths ranging from slightly less to slightly greater than the diameter of the bore 14 have been found appropriate. The exact slot width 18 and bore 14 diameter are to be selected by those skilled in the art given the diameter of the pin contact 92 to be refurbished, the thickness of the abrading element 70, the diameter of the bore 14, and the desired interference between the abrading element 70 and the pin contact 92. By increasing the interference, the abrading pressure applied to the pin contact will be greater. Both the slot 18 and the bore 14 can be formed within the tool body 12 by any suitable method, such as for example by machining.

Figure 5:
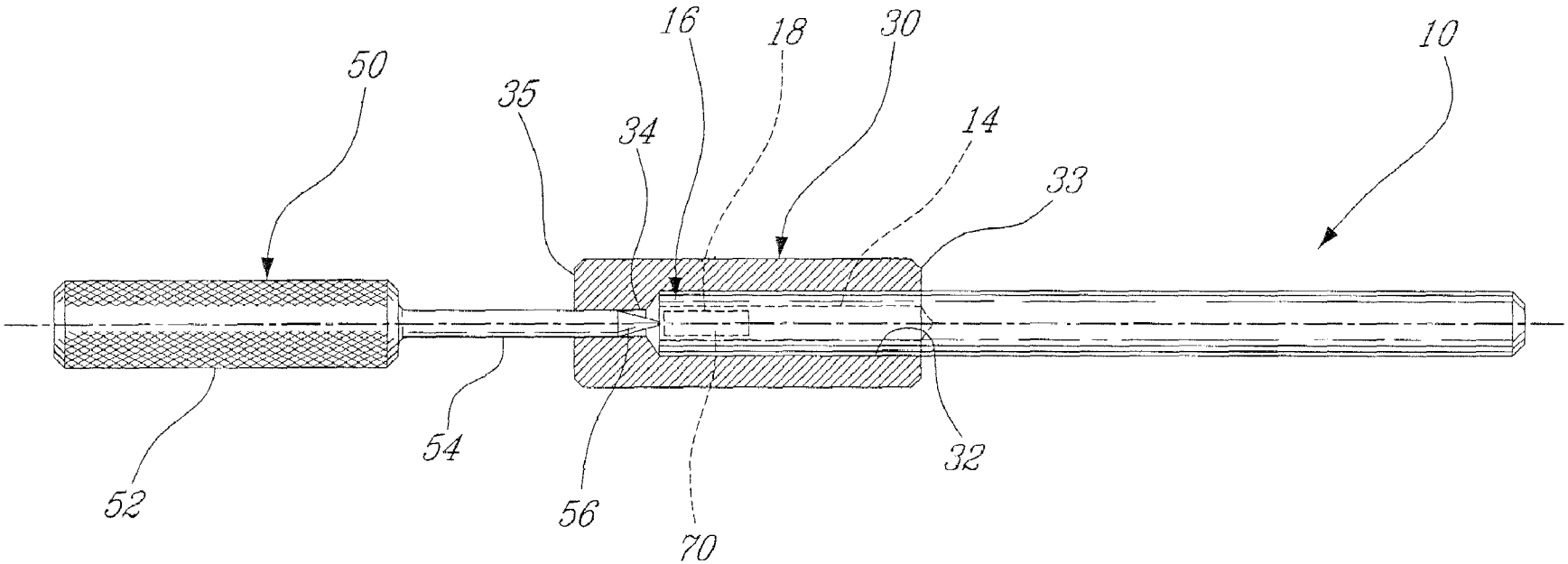
FIG. 5 is a partly sectioned side elevation view of the tool of FIG. 2 in combination with a pointer and bushing guide.

Turning now to FIG. 5, it will be seen that the abrading tool 10 can be advantageously used in conjunction with a separate guiding tool assembly including a bushing guide 30 and a pointer 50, for readying the abrading element 70 for insertion of the pin contact 92. The bushing guide 30 has a tool bore 32 therein extending inwardly from a tool end 33, sized for receiving the first end 16 of the abrading tool 10, and a pin bore 34 extending inwardly from a pin end 35. The tool bore 32 and the pin bore 34 communicate with each other, and are generally oriented along a common central axis. The pointer 50 has a pointer body 52 from which a pin 54 longitudinally extends. The diameter of the pin bore 34 is adapted to allow the pin 54 to be inserted therein. The diameter of the pin 54 is slightly less than the diameter of the bore 14 of the abrading tool 10, to allow for the thickness of the abrading element 70 therebetween.

In use, the end 16 of the abrading tool 10 is inserted into the tool bore 32 of the bushing guide 30, and can be held in place therein by a user with one hand. With the other hand, the user handles the pointer 50 and places the pin 54 thereof into the pin bore 34 of the bushing guide 30. The tip 56 of the pin 54 is pointed, and engages the pin contact reception area 80 (FIG. 4A) between the two folded layers 76, 78 of the abrading element's folded sheet material 70*a*. When the pin 54 is inserted further in by pushing the pointer 50, the folded layers 76 and 78 of the abrading folded sheet material 70*a* are each pressed against opposite internal side walls of the bore 14. When the pin is removed, the abrading folded sheet material 70*a* has a preformed guide opening created by the pin 54, and is ready to receive the pin contact 92.

Although a final abrasion step using a lapping sheet having a suitable abrasive compound is employed in order to finish removing the plating from the pin contact, it is more time efficient to perform an initial sanding operation (i.e. using sandpaper rather than the lapping sheet as the abrading element 70), prior to the lapping operation, which removes a substantial amount of the plating.

In an exemplary method of removing plating using the above-described tool, the tool 10, having an abrading element 70 already installed therein, is placed in a vertical press drill mandrel. In a first step, sandpaper is used as the abrading element 70. The pin contact 92 is slowly introduced into the bore 14 and into contact with the abrading element 70, and the tool is then rotated by the mandrel. The pin is reworked with an up and down motion for a first predetermined period of time. Then, either the sandpaper is removed and replaced with a lapping sheet or pad with appropriate abrasive compound, or the tool is replaced with another tool in which the lapping sheet or pad is already installed. The pin contact is introduced into the preformed hole of the lapping sheet, and the pin is reworked with an up and down motion for a second predetermined period of time, but which is typically less than the first predetermined period of time.

For indicative purposes, the rotating speed of the mandrel can be set to 580 RPM, sandpaper of 240 grit size and abrasive compound of 320 grit size can be used, and the first predetermined period of time and the second predetermined period of time can be 2 minutes and 1 minute, respectively, to remove a gold/nickel plating on a pin contact having about 0.8 mm in diameter. It will be understood that these parameters can be varied.

The lapping sheet can be selected from a plurality of materials adapted to carry the abrasive compound. Typically, the lapping sheet is thicker than a sheet of sandpaper, and if the same tool is used for both the sandpaper and the lapping sheet, a double thickness of sandpaper can be used to fill the gap required for the use of the lapping sheet.

The above description is meant to be exemplary only, and one skilled in the art will recognize that changes may be made to the embodiments described without department from the scope of the invention disclosed. For example, various types of plating from pin contacts of various dimensions can be removed. Further, various types of abrading elements can be used. Still other modifications which fall within the scope of the present invention will be apparent to those skilled in the art, in light of a review of this disclosure, and such modifications are intended to fall within the appended claims.

What is claimed is:

1. An abrading tool for refurbishing pin contacts in situ within an electrical connector, the pin contacts being encircled by a surrounding protective skirt having a height greater than a length of the pin contacts, the abrading tool comprising an elongated body having a first end and a second end and a central longitudinal axis extending therebetween, the second end being remote from the first end by a distance greater than a height of the protective skirt of the electrical connector, a bore being defined in said first end concentric with the central longitudinal axis, the bore having a diameter at least as large as that of the pin contacts, a slot being defined in said first end, said slot extending transversely through the first end and intersecting the bore, a removable abrading element being positioned and maintained inside the slot and having a pin contact reception area communicating with the bore, and a guiding tool assembly cooperative with the first end of the abrading tool and having a protruding guide pin receivable within the bore for positioning and aligning the pin contact reception area of the abrading element within the bore.

2. The abrading tool of claim 1 wherein the abrading element includes a folded sheet material.

3. The abrading tool of claim 2, wherein the folded sheet material is a folded sandpaper sheet having at least two folded layers, the pin contact reception area being defined between the two folded layers.

4. The abrading tool of claim 2, wherein the folded sheet material is a folded lapping sheet having an abrasive compound applied thereon, the folded lapping sheet having at least two folded layers defining the pin contact reception area therebetween.

5. The abrading tool of claim 1, wherein the guiding tool comprises:

a bushing guide having a tool bore for receiving the first end of the abrading tool and a pin bore opposite the tool bore and in communication therewith, the diameter of the pin bore being smaller than that of the bore of the abrading tool; and a pointer having a body and the guide pin having a pin tip extending from the body, the pin being sized to permit the insertion thereof into the pin bore of the bushing guide such that the pin tip extends into the tool bore to create a guide opening in the abrading element positioned therein, thus easing the subsequent entry of the pin contact into the bore of the abrading element.

6. The abrading tool of claim 1 wherein the bore defined in the first end of the elongated body is cylindrical and defines a substantially constant diameter.

7. The abrading tool of claim 6 wherein the elongated body has an outer diameter that is less than twice said substantially constant diameter of the bore.

8. An abrading tool for removing plating from a pin contact in situ within an electrical connector having a plurality of said pin contacts, the abrading tool comprising:

an elongated body having a first and a second longitudinally opposite ends along a central longitudinal axis of the body, the second end being remote from the first end by a distance greater than a total length of the pin contact, the second end being adapted for insertion into a drill mandrel, and the first end having a bore defined therein along a bore longitudinal depth at least as great as the total length of the pin contact, a transversal slot defined in a side of the elongated body immediately adjacent the first end and communicating with the bore along at least a portion of the bore longitudinal depth; and a removable abrading element received within the slot such that a pin contact reception area is aligned with the bore for abrasion of the pin contact when inserted therein; and a guide tool assembly including:

a bushing guide having a tool bore for receiving the first end of the abrading tool, and a pin bore opposite the tool bore and in communication therewith, the diameter of the pin bore being smaller than that of the bore of the abrading tool; and a pointer having a body and a pin having a pin tip extending from the body, the diameter and length of the pin being sized to be received within the pin bore sufficiently to permit the tip thereof to create a guide opening in the abrading element.

9. The abrading tool of claim 8, wherein the transversal slot extends completely through the elongated body.

10. The abrading tool of claim 9, wherein the abrading element is a folded sheet material having at least two folded layers with a pin contact receiving area therebetween.

11. The abrading tool of claim 10, wherein the folded sheet material has an open end opposite a folded end, the open end and folded end being longitudinally sustained by the slot.

12. The abrading tool of claim 11, wherein the folded sheet material is dimensioned to substantially fill the slot without the folded end or the open end thereof extending outside the slot.

13. The abrading tool of claim 8 wherein the bore defined in the elongated body is cylindrical and defines a substantially constant diameter.

14. The abrading tool of claim 13 wherein the elongated body has an outer diameter that is less than twice said substantially constant diameter of the bore.

15. A process of removing the plating of a pin contact in situ within an electrical connector, the pin contacts being encircled by a surrounding protective skirt having a height greater than a length of the pin contacts, the process comprising:

providing an elongated abrading tool having a first end and a second end remote from the first end by a distance greater than a height of the protective skirt of the electrical connector, a bore extending longitudinally into the first end and a transversal slot defined in the tool immediately adjacent the first end and communicating with the bore;

positioning an abrading element having a pin contact reception area inside the bore by insertion thereof through the transversal slot;

providing a brushing guide having a tool bore and a pin bore opposite the tool bore and in communication therewith, providing a pointer having a pin sized for insertion into the pin bore, inserting the first end of the abrading tool into the bore; and creating a guide opening of the abrading element by inserting the pin through the pin bore of the bushing and into the bore of the abrading tool;

inserting the pin contact through an entrance of the bore and into the reception area of the abrading element; and rotating the abrading tool by the second end thereof, such that the abrading element abrades the plating of the pin contact in situ within the electrical connector.

16. The abrading tool of claim 15 wherein the bore defined in the elongated abrading tool is cylindrical and defines a substantially constant diameter.

17. The abrading tool of claim 16 wherein the elongated abrading tool has an outer diameter that is less than twice said substantially constant diameter of the bore.

* * * * *

UNITED STATES PATENT AND TRADEMARK OFFICE

CERTIFICATE OF CORRECTION

PATENT NO. : 7,354,336 B1
APPLICATION NO. : 11/548930
DATED : April 8, 2008
INVENTOR(S) : Serge Lalancette and Serge Castonguay It is certified that error appears in the above-identified patent and that said Letters Patent is hereby corrected as shown below:

claim 15, column 8, line 28, between “the” and “bore”, insert --tool--
claim 15, column 8, line 30, delete “of”, insert --for the pin contact in--
claim 15, column 8, lines 31, 32, between “bushing” and “and”, insert --guide--

Signed and Sealed this

Eighth Day of July, 2008

JON W. DUDAS
*Director of the United States Patent and Trademark Office*